United States Patent [19]

Nakamura

[11] Patent Number: 4,915,049

[45] Date of Patent: Apr. 10, 1990

[54] STEERING HANDLE DEVICE FOR JET-PROPELLED SMALL-SIZED BOATS

[76] Inventor: Yukio Nakamura, 5-6, 1-Chome, Tengachayakita, Nishinari-Ku, Osaka-Shi, Osaka-Fu, Japan

[21] Appl. No.: 265,375

[22] Filed: Oct. 31, 1988

[51] Int. Cl.[4] ..... B63B 35/56; B62K 21/16

[52] U.S. Cl. ..... 114/144 R; 114/270

[58] Field of Search ..... 114/144 R, 270; 440/38, 440/40; 74/551.1–551.9

[56] References Cited

U.S. PATENT DOCUMENTS

| | | | |
|---|---|---|---|
| 4,023,436 | 5/1977 | Dodge | 74/551.4 |
| 4,745,872 | 5/1988 | Nakamura | 114/144 R |
| 4,748,928 | 6/1988 | Nakamura | 114/270 |

FOREIGN PATENT DOCUMENTS

| | | | |
|---|---|---|---|
| 614303 | 12/1926 | France | 74/551.4 |

OTHER PUBLICATIONS

Kawasaki, JS550–A, Jet Ski Watercraft Parts Catalog, Kawasaki Heavy Industries, Ltd. 1984.

Jetski World, vol. 1, 1987.

*Primary Examiner*—Sherman D. Basinger

*Assistant Examiner*—Edwin L. Swinehart

*Attorney, Agent, or Firm*—Armstrong, Nikaido, Marmelstein, Kubovcik & Murray

[57] ABSTRACT

The present invention relates to a steering handle device for jet-propelled small-sized boats of the type in which: structurally, the stern of the boat is adapted for use as a floor deck on which the rider stands, with an engine mounted on the front portion of the floor deck; a handle post is pivotally connected at its front or lower end to the bow of the boat by a horizontal shaft so that it is swingable; a base board for attaching the handle bar is integrated with the rear or upper end of the handle post overhanging the floor deck, and an attaching plate for the handle bar is pivotally connected to the base board by a vertical shaft; the rider holding the handle bar steers the boat to freely slide over water surface while changing the position at which the foot pressure is applied to the boat; the steering handle device being characterized in that: the handle bar is constructed in a substantially H-shape in a front view consisting of a handle bar body horizontally extending transversely of the boat, and a pair of grips vertically extending from the opposite ends of the handle bar body; the middle portion of the handle body is integrally fixed to the rear end of the attaching plate; mouth pieces each extending through the intermediate portion of the associated grip at right angles and fixed thereto are fitted on the opposite ends of the handle bar body so that they can be removed and refitted thereon for angular adjustment; the tilt angle of each grip with respect to the horizontal plane of the handle bar body can be adjusted by tilting the grip forward or rearward while turning the grip around the horizontal longitudinal axis of the handle bar body during the operation of removing and refitting for adjustment.

4 Claims, 9 Drawing Sheets

STEERING HANDLE DEVICE FOR JET-PROPELLED SMALL-SIZED BOATS

BACKGROUND OF THE INVENTION

Generally, in jet-propelled small-sized boats which glide over water surface, a single person rides the boat in a standing posture on the floor deck of the boat with his hands gripping the handle bars to rotate them for steering so as to control a steering cable extending from a handle post via the boat interior to the stern to swing the steering nozzle of the jet propelling device (water jet pump) for steering the boat.

During riding, the rider intentionally changes the position of application (position of the center of gravity of the boat) of the foot pressure (rider's body weight) on the floor deck of the boat, thus causing the boat not only to glide over water surface in a curve but also to jump above water surface or, reversely, to dive. In this manner, the rider steers the boat to change its posture as desired while enjoying the high technique required to make such change or competing in such technique, a fact attributable to the increasing popularity of this type of boats particularly among the young.

In a conventional boat of this type, however, as is clear from FIGS. 9 through 11, a handle post 1 is pivotally connected at its front or lower end to the boat a by a horizontal shaft 2 to allow its rear or upper end to swing in arcuate movement. A handle bar attaching plate 5 pivotally connected through a vertical shaft 4 to a base board 3 attached to said rear or upper end which swing in such arcuate movement is integrated with a handle bar b at the middle as by welding; therefore, when the level of the upper or rear end of the handle post 1 increases as the arcuate movement of said handle post 1 proceeds, the rider has to shift his position toward the front of the floor deck 6 or, reversely, if the level of the handle bar b decreases, he is forced to stand at a position nearer to the rear of the floor deck 6.

Thus, the standing position of the rider is consequently influenced by such changes in the level of the handle post 1, and the steering operation is limited in changing the position at which the foot pressure is applied to the boat. As a result, it becomes difficult to steer the boat a to change its posture, as desired. Further, the capability of the boat to cope with the rider's physical build and steering technique which vary from rider to rider is degraded.

In this connection, according to U.S. Pat. No. 4,745,872 previously proposed by the present inventor, structurally, the attaching bracket A of the handle bar 16 is divided into a front bracket 17 and a rear bracket 21. Since the position at which the rear bracket 21 is connected to the front bracket 17 is adjustable, the rear bracket 21 can be slid for adjustment to the rider's physical build and steering technique which vary from rider to rider; thus, the disclosed arrangement is advantageous in that the aforesaid problem has been solved in this manner.

However, in the case of the invention of U.S. Pat. No. 4,745,872, a pair of grips 27 at the handle bar 17 are integrated with the opposed ends of the straight extensions of said bar and extend substantially horizontally in rearwardly diverging form as seen in a plan view. Therefore, the rider assumes a steering posture in which the backs of the hands holding the grips 27 are turned upward, with the armpits opened wide.

As a result, the foot pressure resulting from the rider's body weight cannot be applied to the boat 10 effectively and rationally from the standpoint of human engineering, and it is also difficult to steer the boat in a stabilized manner while exerting an effective resistance to the force which tends to throw away the rider's body during the revolving of the boat 10. It should be said that the disclosed arrangement leaves room for improvement in the feeling of integration between the rider and the boat and is difficult to operate.

Further, since the handle post 13 is swung around the axis of the horizontal shaft 14 at its front or lower end, its tilt angle with respect to the floor deck 11 also varies. Since the handle bar 16 is rigidly attached to the rear or upper end of the handle post through the base board 15 and the attaching bracket A, the posture and the direction of extension of the grips 27 on the handle bar 16 also vary, and there will arise another problem that the rider fails to stably hold the grips without adversely affecting his steering posture. And such problems likewise arise in the conventional product shown in FIGS. 9 through 11.

SUMMARY OF THE INVENTION

The present invention has been accomplished to solve such problems and a first object of the invention is to provide an arrangement using a handle bar which comprises a handle bar body horizontally extending transversely of the boat, and a pair of grips extending vertically from the opposite ends of said handle bar body so that said handle bar, when seen in a plan view, is substantially H-shaped, whereby the rider is kept in a steering posture in which the backs of the rider's hands holding said grips are directed sideways, with his armpits tightly closed, enabling the rider to steer the boat in a stable manner while preventing his body from being shaken during the revolving of the boat, also enabling the rider to apply the foot pressure resulting from his body weight to the boat without loss and rationally from the standpoint of human engineering, the steerability being thus improved.

A second object of the invention is to provide an arrangement wherein a handle bar attaching base board is integrated with the rear or upper end of a handle post adapted to swing around the axis of a horizontal shaft by which the handle post is attached to the boat, said base board having a handle bar attaching plate pivotally connected thereto by a vertical shaft, the rear end of said attaching plate having fixed thereto the middle portion of said handle bar body, said handle bar body having grips fitted thereon such that they can be removed and refitted thereon for angular adjustment, the tilt angle of said grips with respect to the horizontal plane of the handle bar body being adjusted by removing and refitting said grips while turning them around the horizontal longitudinal axis of the handle bar body during the operation of removing and refitting for adjustment, whereby anyone can use the boat in such a manner that he is allowed to stand at a desired position on the boat while stably holding the grips irrespective of such factors as a change in the level of the upper or rear end of the handle post, a change in the tilt angle of the handle post with respect to the plane of the floor deck, a difference in the size of the rider's physical build and a difference in the personal level of steering technique, and wherein when the position at which the foot pressure is applied to the boat is to be intentionally changed, this can be effected smoothly, accurately and efficiently without involving physical limitations or forced irrational steering posture.

The tilt angle of the grips with respect to the horizontal plane of the handle bar body is adjusted to a change in the level of the rear or upper end of the handle post or a change in the tilt angle formed between the handle post and the plane of the floor deck, whereby anyone can steer the boat in the most suitable steering posture and the foot pressure can be effectively applied to the boat at a desired position. Further, the feeling of integration between the rider and the boat can also be improved.

A third object of the invention is to provide an arrangement wherein the handle bar attaching plate is in the form of an assembly comprising a pair of plates, i.e., a front plate pivotally connected to the base board by a vertical shaft, and a rear plate assembled to said front plate in such a manner as to be adjustable longitudinally of said front plate, and wherein the middle portion of said handle bar body is fixed to the rear end of said rear plate, thereby further improving the arrangement provided by said second object.

Other objects of the present invention will become more apparent from the detailed description of embodiments when taken in conjunction with the accompanying drawings.

DESCRIPTION OF THE PREFERRED EMBODIMENTS

Figure 1:
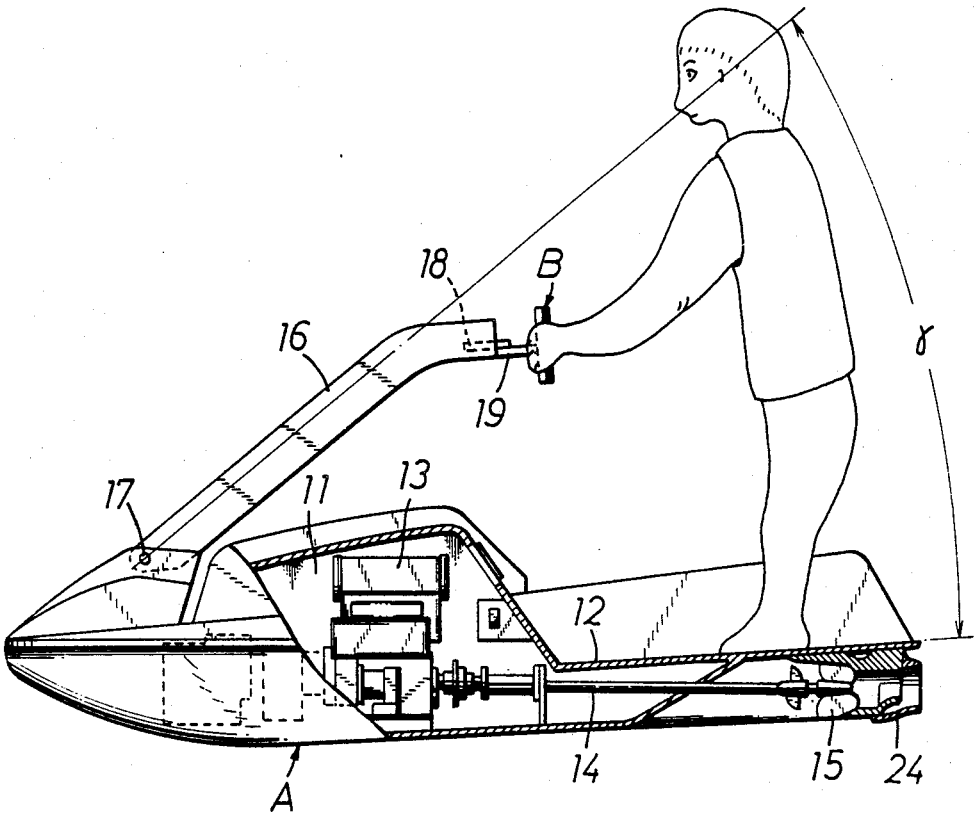
FIG. 1 is a complete schematic side view, partly broken away, of a jet-propelled small-sized boat according to the present invention.

The concrete arrangement of the present invention will now be described in detail with reference to the accompanying drawings. FIG. 1 schematically shows a jet-propelled small-sized boat in its entirety according to the invention. The character A generally denotes a boat built in a hollow sealed type of float construction from fiber-reinforced plastic (FRP). The front half of the boat has an engine room 11 defined therein and the rear half is adapted for use as a floor deck 12 on which the rider stands.

The numeral 13 denotes an engine installed in the engine room 11, whereby a jet-propelling device (water jet pump) 15 is driven through a propeller shaft 14, thus imparting a propelling force to the boat A. The numeral 16 denotes a handle post pivotally connected to the bow of the boat by a horizontal shaft 17 so that it is swingable, and the rear or upper end of said handle post overhanging the floor deck 12 has a handle bar attaching base board 18 integrally fixed thereto in a lining fashion.

A steering handle device which follows is attached to the base board. In FIGS. 2 through 6 showing said steering handle device in enlarged views, the numeral 19 denotes an attaching plate for a handle bar B, said attaching plate comprising a pair of plates, i.e., a front plate 20 and a rear plate 21. The front plate 20 is applied to the lower side of said base board 18 and pivotally connected thereto by a vertical shaft 22 so that it is revolvable around the axis of said vertical shaft 22.

Figure 2:
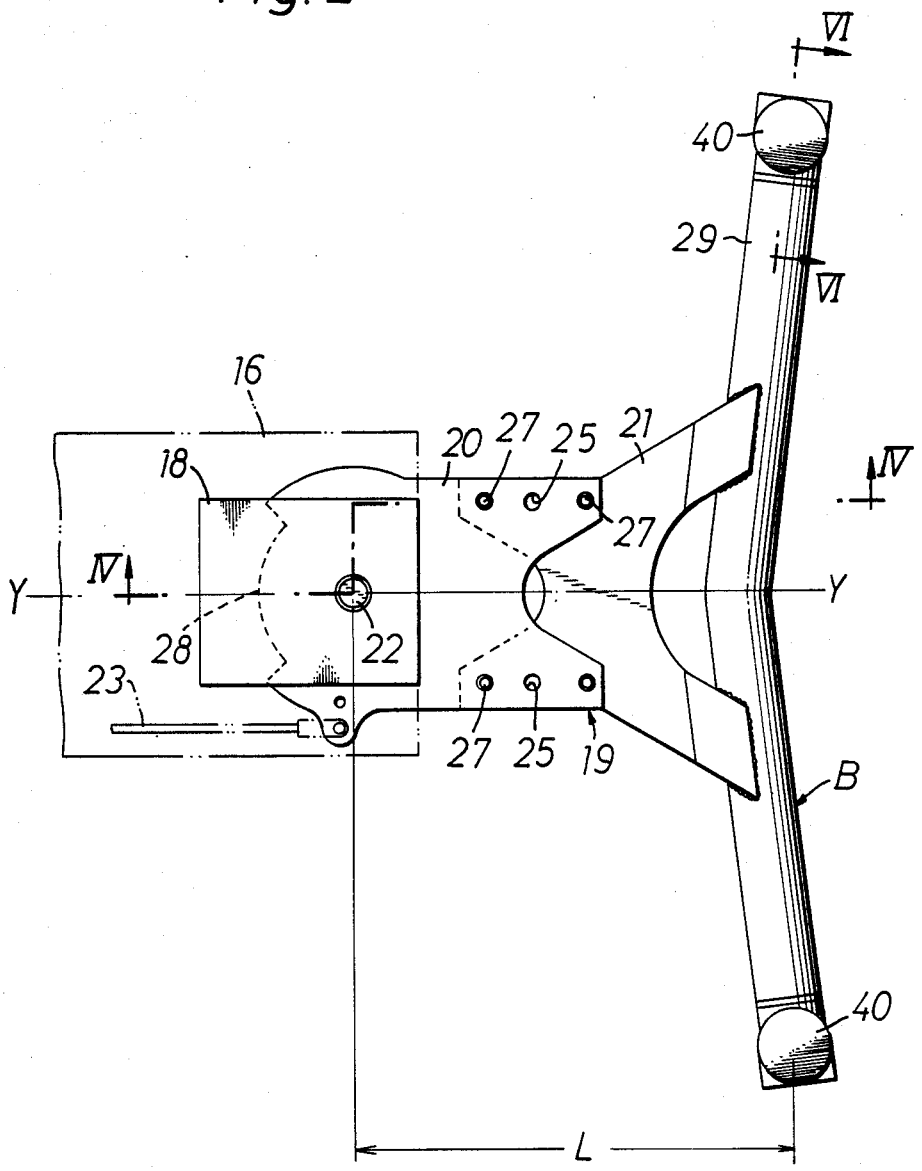
FIG. 2 is an enlarged plan view of a steering handle device extracted therefrom.
Figure 3:
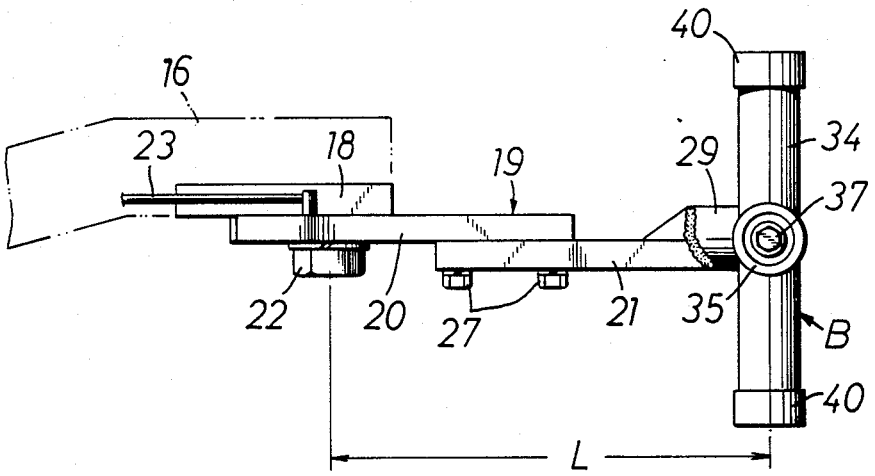
FIG. 3 is side view of the handle device.
Figure 4:
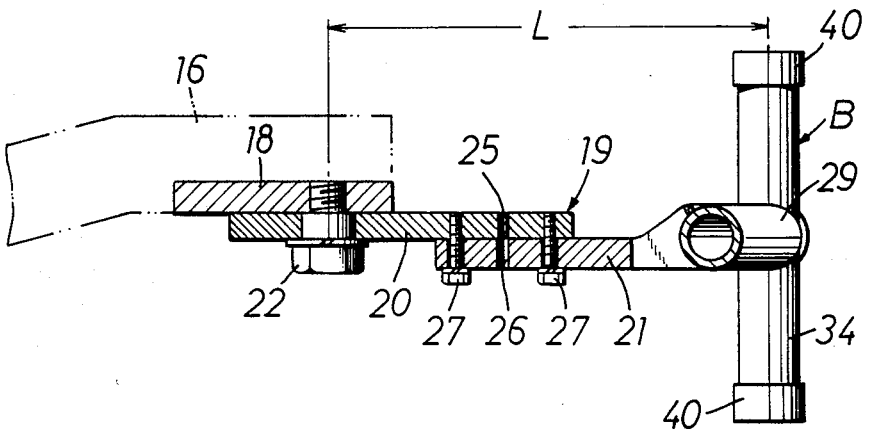
FIG. 4 is a sectional view taken along the line IV—IV in FIG. 2.

The vertical shaft 22 lies on the travel center line Y—Y of the boat A, while the initial end of a steering cable 23 is attached to the front plate 20 at an offset point deviated laterally to the left or right side, as shown in FIGS. 2 and 3. It goes without saying that the terminal end of said steering cable 23 extends rearward through the handle post 16 and the boat A and is connected to a steering nozzle 24 belonging to the jet propelling device 15 in the stern.

The numeral 25 denotes a plurality of pairs of adjusting threaded holes in the rear portion of the front plate 20, two holes one on each side forming a pair, and a plurality of pairs of plain holes 26 aligned with said threaded holes are formed in the front portion of said rear plate 21. Thus, in joining the rear plate 21 to the lower side of the front plate 20, fixing bolts 27 are screwed into desired threaded holes 25 through the associated plain holes 26, whereby the pair of front and rear plates 20 and 21 can be put together.

In other words, it is arranged that the handle bar B belonging to the attaching plate 19 can be adjusted and set in advance in relation to the length L measured from said vertical shaft 22 toward the rear (i.e., to the attaching position for the handle bar). Thus, so long as this purpose can be accomplished, this arrangement may be reversed by forming said adjusting plain holes 26 in the front plate 20 while forming said adjusting threaded holes 25 in the rear plate 21.

In either case, since the attaching position for the handle bar B can be adjusted longitudinally of the boat A and since the rear or upper end of the handle post 16 is swingable around the axis of said horizontal shaft 17, the rider's physical build and steering technique which vary from rider to rider can be coped with and the position at which the foot pressure is applied to the boat A can be changed as desired by any rider.

The numeral 28 denotes a notch for limiting to a predetermined value the angle of revolution of the attaching plate 19 around the axis of the vertical shaft 22, said notch being in the form of an arc as shown in FIG. 2 and formed in the front edge of the front plate 20. A pin adapted to engage said limiting notch 28 projects from the base board 18; this pin is omitted from illustration.

Figure 5:
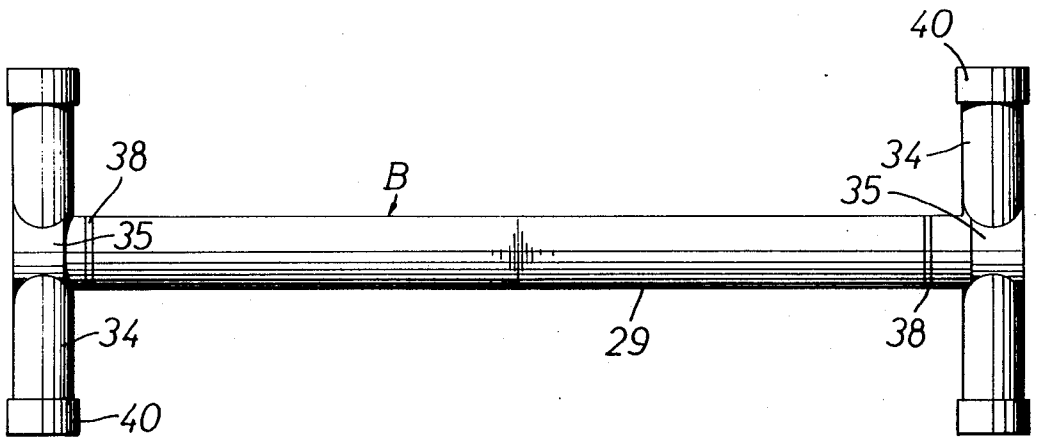
FIG. 5 is a front view showing a handle bar.

The handle bar B itself mentioned previously is substantially H-shaped in a front view as shown extracted in FIG. 5 and is formed of a round pipe or bar.

More particularly, the numeral 29 denotes a handle bar body horizontally extending transversely of the boat A and in a plan view shown in FIG. 2 it is gently bent in its horizontal plane with its opposite ends slightly extending rearward; however, said handle bar body 29 may, of course, be made straight as a whole. And the middle portion of the handle bar body 29 is fixed to the rear plate 21 in said attaching plate 19 as by welding or a connecting bracket (not shown).

The numerals 30 and 31 denote a primary diameter-reduced shaft portion and a secondary diameter-reduced shaft portion, respectively, which are formed on each end of the handle bar body 29 and form a pair, the secondary diameter-reduced shaft portion 31 disposed in the front region being thinner than the primary diameter-reduced shaft portion 30. The numeral 32 denotes a recess and ridge combination such as splines or serrations formed on the outer round surface of the primary diameter-reduced shaft portion 30 and extending longitudinally of the handle bar body 29, and the numeral 33 denotes a male thread cut in the round outer surface of the secondary diameter-reduced shaft portion 31.

The numeral 34 denotes a pair of grips separate from the handle bar body 29, each of said grips being formed of a relatively short round metal pipe and has a mouth piece 35 for the handle bar body 29, said mouth piece extending through the center of the length of the grip at right angles and welded thereto.

Figure 6:
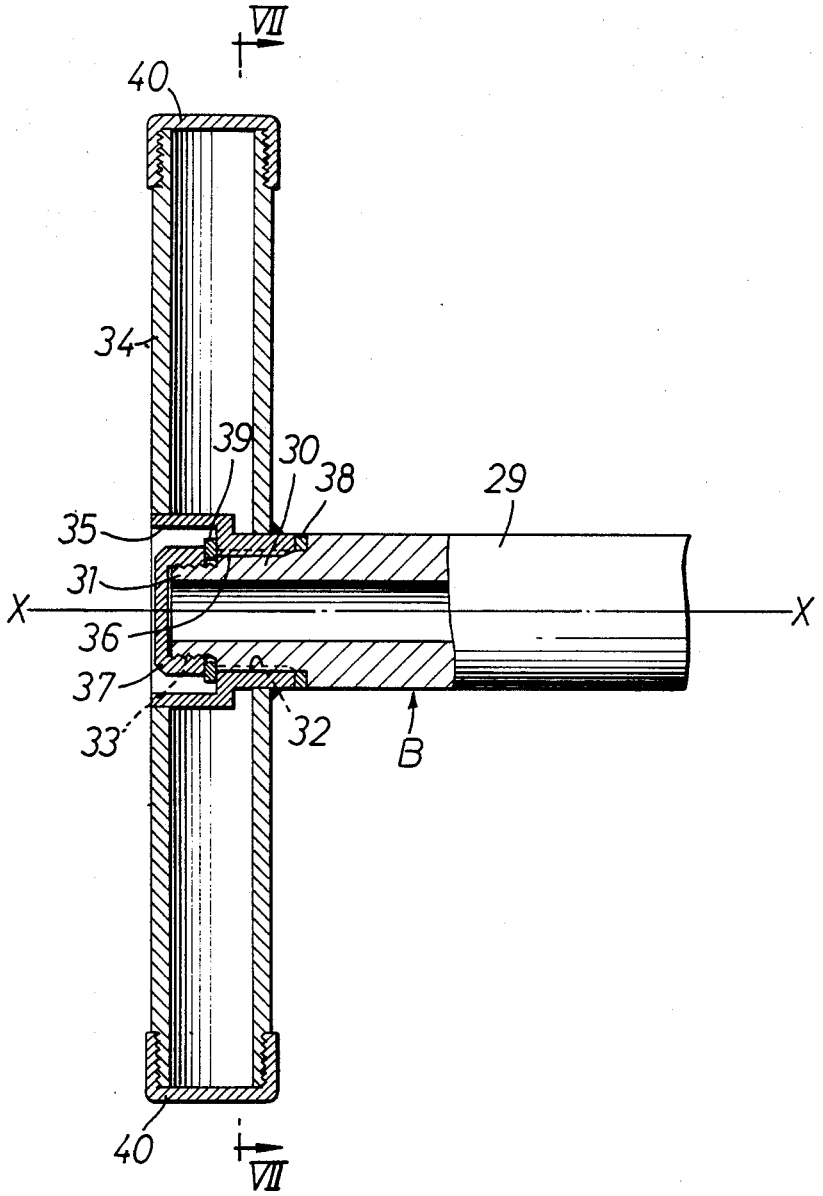
FIG. 6 is a partial enlarged sectional view taken along the line VI—VI in FIG. 2.
Figure 7:
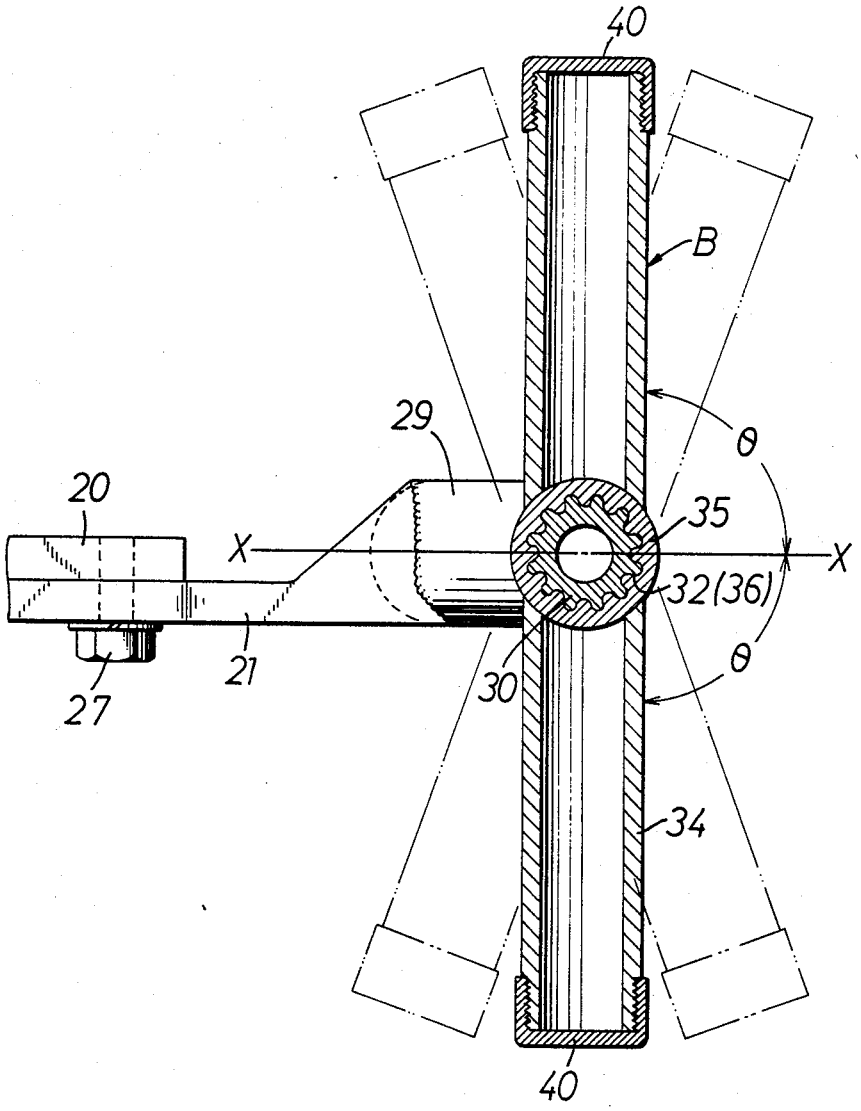
FIG. 7 is a partial sectional view taken along the line VII—VII in FIG. 6.

The mouth piece 35 for each grip 34 is removably fitted laterally on the handle bar body 29, as shown in FIGS. 6 and 7, and then fixed in position against slip-off by the clamp nut 37 removably screwed laterally on the male thread 33 of the secondary diameter-reduced shaft portion 31. The numerals 38 and 39 denote washers and 40 denotes end caps.

In this manner, the pair of grips 34 assembled to the handle bar 29 each extend in a plane which is orthogonal to the horizontal plane X—X of the handle bar body 29. Therefore, the entire handle bar B, when seen longitudinally of the boat A, is substantially H-shaped. In the assembled state, since the recess and ridge combination 32 in the handle bar body 29 is engaged with the recess and ridge combination 36 in the grip 34, there is, of course, no relative rotation between the handle bar body 29 and the grip 34.

The tilt angel $\theta$ of the grip 34 with respect to the horizontal plane X—X of the handle bar body 29 can be adjusted by removing the clamp nut 37 from the assembled state, extracting the grip 34 from the bar body 29, refitting the grip 34 on the handle bar body 29 while tilting the grip 34 forward or rearward as suggested by phantom lines in FIG. 7, and applying the clamp nut 37 again so as to prevent the grip 34 from slipping off. It is understood that the present invention has been arranged so that such adjustment can be made.

Figure 8:
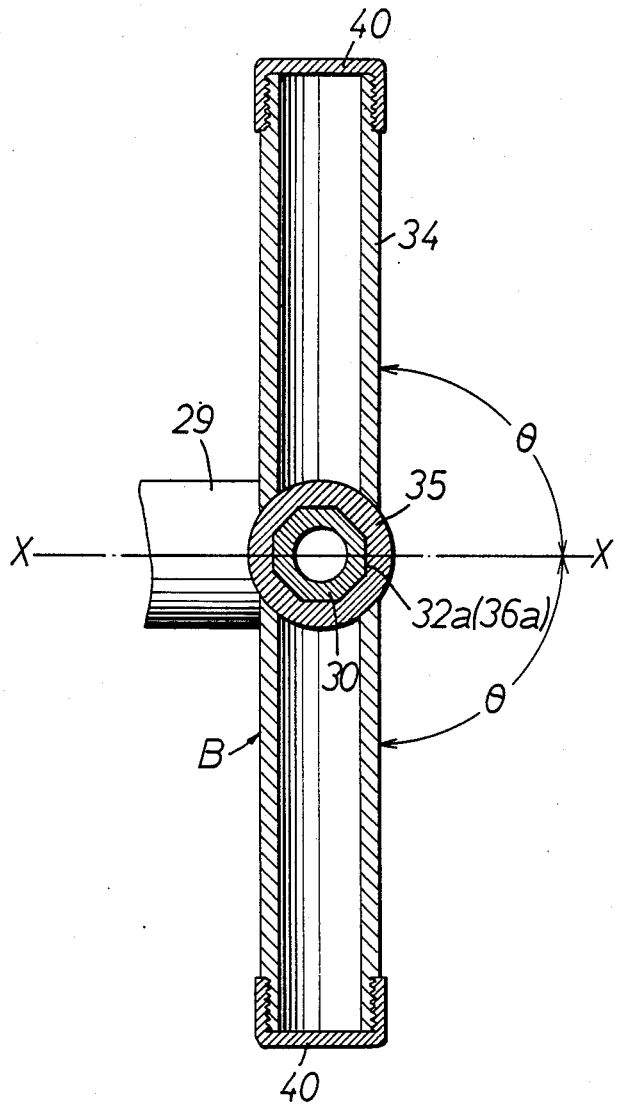
FIG. 8 is a sectional view corresponding to FIG. 7, showing a modified embodiment of the manner of assembling the grips.
Figure 10:
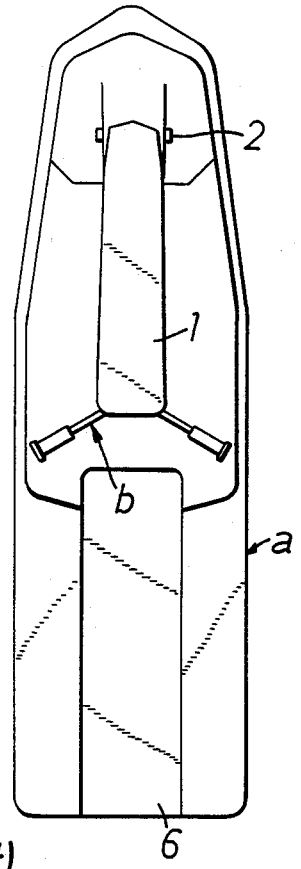
Fig.10 (Prior Art)
FIGS. 9 and 10 are a side view and a plan view, schematically showing a conventional jet-propelled small-sized boat in its entirety.
Figure 9:
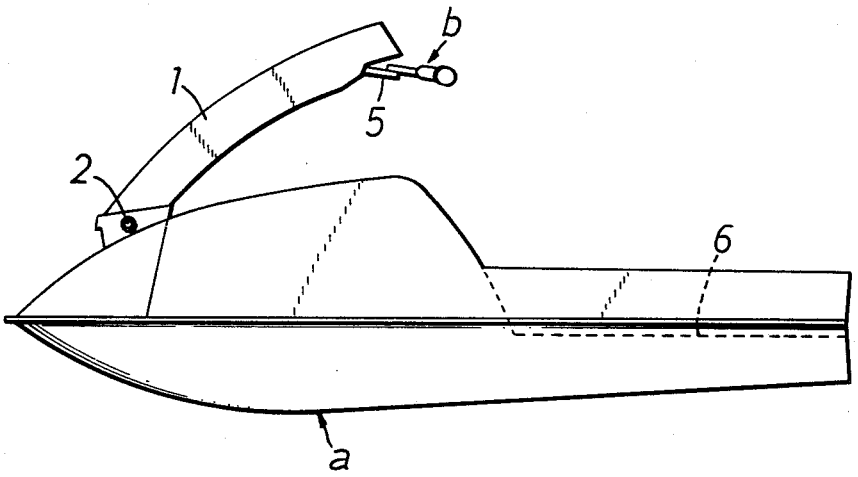
Fig.9 (Prior Art)
Figure 11:
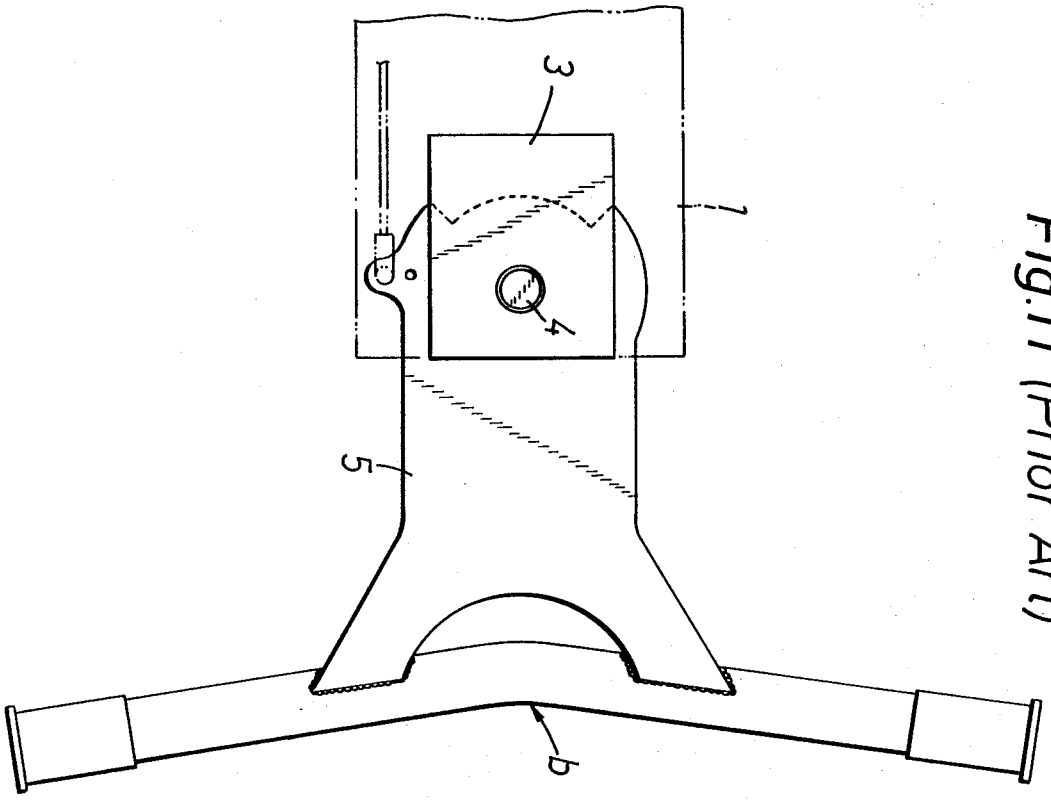
Fig.11 (Prior Art)
FIG. 11 is an enlarged plan view of a steering handle device extracted therefrom.

However, so long as the arrangement is made so that the tilt angle $\theta$ of the grip 34 can be adjusted, said recess and ridge combinations 32 and 36 which can be separably put together may be replaced by an arrangement shown in a modified embodiment in FIG. 8. In this modified embodiment, the outer peripheral surface of the primary diameter-reduced shaft portion 30 in the handle bar body 29 is defined by a shaft surface 32*a* in the form of a regular polygon, while the inner peripheral surface of the mouth piece 35 is shaped as a polygonal groove surface 36*a* which can be removably fitted thereon. According to this arrangement, as in the basic embodiment shown in FIGS. 2 through 7, the tilt angle $\theta$ of the grip 34 with respect to the horizontal plane of the handle bar body 29 can be adjusted. Therefore, even if the level of the rear or upper end of the handle post 16 changes or the tilt angle $\gamma$ of the handle post 16 with respect to the varies, the grip 34 can be adjusted by extracting the grip 34 and then refitting it on the handle bar body 29 while suitably turning it for adjustment to such variation; thus, the grip 34 can be adjusted so that anyone can hold the same with ease.

As described so far, according to the steering handle device of the invention, the handle bar B is in substantially H-shaped form, as seen in a front view, comprising a handle bar body 29 horizontally extending transversely of the boat A, and a pair of grips 34 vertically extending from the opposite ends of said handle bar body 29. Therefore, the rider assumes a steering posture in which the backs of his hands holding the intersections between the grips 34 and the handle bar body 29 are turned sideways, as shown in FIG. 1, with his armpits closed tight.

As a result, the lifting and depressing of the handle post 16 by the wrists can be effected with less effort, and the foot pressure resulting from the rider's body weight can be rationally applied to the boat A without loss. And it is also possible to exert an effective resistance to the force produced during the revolving of the boat and tending to throw away the rider. The rider is allowed to safely steer the boat with the improved feeling of integration between the rider and the boat A.

Furthermore, the grips 34 are formed independently of the handle bar body 29 and are fitted on the opposite ends of the bar body 29 such that they can be removed and refitted thereon for angular adjustment as they are turned around the longitudinal axis of the bar body 29. And the tilt angle $\theta$ of the grips 31 with respect to the horizontal plane X—X of the handle bar body 29 is adjustable, whereby anyone can use the boat A in such a manner that he is allowed to stand at a desired position on the boat A while stably holding the grips by adjusting the tilt angle $\theta$ of the grips 31 to the most suitable value in accordance with such factors as a change in the level of the upper or rear end of the handle post 16, a change in the tilt angle $\gamma$ with respect to the plane of the floor deck 12, a difference in the size of the rider's physical build and a difference in the personal level of steering technique. Further, the position at which the foot pressure is applied to the boat A can be freely changed.

In that case, the attaching plate 19 for the handle bar B is made in the form of an assembly comprising a front plate 20 pivotally connected to the base board 18 by a vertical shaft 22, and a rear plate 21 longitudinally adjustably attached to said front plate 20. Thus, if the handle bar B is fixed to the rear end of the rear plate 21, then the position of attachment of the handle bar B itself can be longitudinally changed by moving the rear plate 21 forward or rearward, so that the aforesaid effect can be further improved. Thus, the essential arrangement is relatively simple and parts can be mass-produced, a fact which is very useful.

What is claimed is:

1. A steering handle device for jet-propelled small-sized boats of the type in which:

the stern of the boat is adapted for use as a floor deck on which the rider stands, with an engine mounted on the front portion of said floor deck;

a handle post is pivotally connected at its front lower end to the bow of the boat by a horizontal shaft so that it is swingable;

a base board for attaching a handle bar is integrated with a rear upper end of the handle post overhanging the floor deck, and an attaching plate for the handle bar is pivotally connected to the base board by a vertical shaft;

a rider holding the handle bar steers the boat to freely slide over water surface while changing the position at which the rider's foot pressure is applied to the boat;

said steering handle device being characterized in that:

said handle bar is constructed in a substantially H-shape in a front view consisting of a handle bar body horizontally extending transversely of the boat, and a pair of grips generally vertically extending from the opposite ends of said handle bar body;

a middle portion of the handle bar body is integrally fixed to the rear end of the attaching plate, mouth pieces each extending through the center of the associated grip at a right angle with respect to the generally vertical extent of the associated grip, and fixed thereto, the mouthpieces are fitted on the opposite ends of the bar body and fixed in position such that they can be removed and refitted thereon for angular tilt adjustment of the grips, whereby, the tilt angle of the grip with respect to a horizontal plane containing the bar body can be adjusted by tilting the grip forward or rearward by turning it around the horizontal longitudinal axis of the handle bar body

2. A steering handle device for jet-propelled small-sized boats as set forth in claim 1, characterized in that:

the attaching plate for the handle bar is in the form of an assembly comprising a front plate pivotally connected to the base board by a vertical shaft, and a rear plate longitudinally adjustably connected to said front plate;

the middle portion of the handlebar body is fixed to the rear end of the rear plate.

3. A steering handle device for jet-propelled small-sized boats as set forth in claim 1, characterized in that recess and ridge means which can be fitted together are formed on the grips and mouth pieces at the opposite ends of the handle bar body.

4. A steering handle device for jet-propelled small-sized boat as set forth in claim 1, characterized in that the grips and mouth pieces at the opposite ends of the handle bar body are mutually engageable regular polygons in cross section.

* * * * *